United States Patent [19]

Gamm

[11] Patent Number: 4,989,284

[45] Date of Patent: Feb. 5, 1991

[54] CUSHION

[75] Inventor: Paul B. Gamm, Cincinnati, Ohio

[73] Assignee: The Kendall Company, Boston, Mass.

[21] Appl. No.: 420,272

[22] Filed: Oct. 12, 1989

[51] Int. Cl.[5] ..... A47C 27/00

[52] U.S. Cl. ..... 5/468; 5/448

[58] Field of Search ..... 5/431, 446, 449, 450, 5/451, 461, 468, 470, 448; 297/458, 459, DIG. 1

[56] References Cited

U.S. PATENT DOCUMENTS

| | | | |
|---|---|---|---|
| 1,922,228 | 8/1933 | Brown . | |
| 2,150,287 | 3/1939 | Minor . | |
| 2,659,418 | 11/1953 | Berman . | |
| 2,784,773 | 3/1957 | Rowland | 5/461 |
| 3,083,380 | 4/1963 | Adler | 5/464 |
| 3,095,239 | 6/1963 | Henderickson . | |
| 3,205,515 | 9/1965 | Unger . | |
| 3,258,791 | 7/1966 | Kaplan . | |
| 3,462,779 | 8/1969 | Thompson . | |
| 3,503,649 | 3/1970 | Johnson . | |
| 3,574,873 | 4/1971 | Weinstein | 5/451 X |
| 3,612,607 | 10/1971 | Lehr . | |
| 3,679,263 | 7/1972 | Cadlou . | |
| 3,736,022 | 5/1973 | Radke . | |
| 3,818,522 | 6/1974 | Schuster . | |
| 3,855,653 | 12/1974 | Stalter, Sr. | 5/478 |
| 3,983,587 | 10/1976 | Gorran . | |
| 4,064,578 | 12/1977 | Yamada . | |
| 4,070,719 | 1/1978 | Morgan | 5/468 X |
| 4,092,750 | 6/1978 | Ellis . | |
| 4,092,751 | 6/1978 | Burkholder et al. . | |
| 4,132,228 | 1/1979 | Green . | |
| 4,164,798 | 8/1979 | Weber . | |
| 4,320,543 | 3/1982 | Dixon . | |
| 4,368,917 | 1/1988 | Ural . | |
| 4,403,356 | 9/1983 | Urai | 5/458 X |
| 4,422,194 | 12/1983 | Viestors et al. | 5/451 |
| 4,485,505 | 12/1984 | Paul | 5/449 X |
| 4,605,582 | 8/1986 | Sias et al. . | |
| 4,614,000 | 9/1986 | Mayer . | |
| 4,643,481 | 2/1987 | Saloff et al. . | |
| 4,688,285 | 8/1987 | Roberts | 5/468 |
| 4,698,864 | 10/1987 | Graebe | 5/464 X |
| 4,726,624 | 2/1988 | Jay | 5/450 X |
| 4,773,792 | 9/1988 | Takahaski et al. . | |

FOREIGN PATENT DOCUMENTS

| | | | |
|---|---|---|---|
| 110178 | 4/1940 | Australia | 5/468 |
| 1178823 | 1/1970 | United Kingdom | 5/464 |

OTHER PUBLICATIONS

Elasto Gel Seat Cushions–Southwest Technologies, Incorporated.

Roho Cushion–Roho, P.O. Box 866 E. St. Louis, IL.

Stbergistic Tri-Oad–Everest & Jennings, Inc., L.A., CA.

DuraFoam Cushion O Everest & Jennings Inc., L.A., CA.

Jay Cushion–Jay Medical, Boulder, CO.

*Primary Examiner*—Michael F. Trettel

*Assistant Examiner*—Michael J. Milano

*Attorney, Agent, or Firm*—Wood, Herron & Evans

[57] ABSTRACT

A cushion having a series of pods connected in a matrix configuration. The pods are deformable in response to a person seated on the cushion. The pods cooperate to define primary airflow channels through the cushion from side edge to side edge, and from front edge to back edge, thereof. In one feature, a series of cruciform configured recesses are defined in the pods' top surfaces. These recesses cooperate to define secondary airflow channels through the cushion from side edge to side edge, and from front edge to back edge, thereof. In another feature, a series of first pods are located in those cushion areas which underlie and support a person's ischial and coccyx bones, and a series of second pods located in those cushion areas which do not underlie and support a person's ischial and coccyx bones. The first pods have a relatively thin wall covering a foamed interior and are of a relatively greater height to provide relatively soft pods. The second pods have a relatively thick wall covering a foamed interior and are of a relatively lesser height to form relatively firm pods. These difference in load bearing characteristics between the first and second pods aids in minimizing the pressure on a user's ischial and coccyx bones when seated on the cushion.

19 Claims, 2 Drawing Sheets

CUSHION

This invention relates to seating systems. More particularly, this invention relates to cushions, and especially to those cushions on which the infirm must sit for extended periods.

The use of a cushion to enhance seating comfort is very old and well known in the art. Specially designed cushions to enhance the seating comfort of the infirmed and of the invalid are also well known in the art. Those persons who are not able to walk with regularity, i.e., those persons who must normally remain seated, can over time develop a particular problem not known to those who regularly walk. This is a skin problem on the person's buttocks and associated upper leg areas which is primarily the result of lack of ventilation for perspiration that occurs while as the person is seated. In some situations, decubitus ulcers is the result. Decubitus ulcers can be painful, and are difficult, if not impossible, to heal if a person must continuously remain in a seated position.

Accordingly, it has been one objective of this invention to provide an improved cushion which provides airflow ventilation around, and which tends to minimize perspiration on, the buttocks of a person seated thereon, thereby minimizing skin breakdown and resultant decubitus ulcers on that person.

It has been another objective of this invention to provide an improved cushion with different degrees of softness to accept the variable load distribution which occurs when a person sits on the cushion, same providing a higher relative softness in those cushion areas which underline the person's ischial and coccyx bones so as to provide maximum pressure relief to the person's buttocks in those areas, and a lower relative softness in those cushion areas under the person's thigh areas, as well as in the other cushion areas, so as to more equalize the person's load distribution throughout the surface area of the cushions.

In accord with these objectives, the improved cushion of this invention includes cushion having a series of pods connected in a matrix configuration. The pods are deformable in response to a person seated on the cushion. The pods cooperate to define primary airflow channels through the cushion from side edge to side edge, and from front edge to back edge, thereof. In one feature, a series of cruciform configured recesses are defined in the pods' top surfaces. These recesses cooperate to define secondary airflow channels through the cushion from side edge to side edge and from front edge to back edge thereof. In another feature, a breathable foam layer is positioned on top the pods, and a flexible open mesh substrate is interposed between the foam layer and the pods. The mesh substrate prevents the foam layer from being significantly deformed into the primary and secondary airflow channels when a person is seated on the cushion. A third feature includes a series of first pods located in those cushion areas which underlie and support a person's ischial and coccyx bones, and a series of second pods located in those cushion areas which do not underlie and support a persons ischial and coccyx bones. The first pods have a relatively thin wall covering a foamed interior and are of a relatively greater height to provide a relatively soft pod. The second pods have a relatively thick wall covering a foamed interior and are of a relatively lesser height to form a relatively firm pod. These difference in load bearing characteristics between the first and second pods aids in minimizing the pressure on a user's ischial and coccyx bones when seated on the cushion.

Other objectives and advantages of the invention will be more apparent from the following detailed description taken in conjunction with the drawings in which.

Figure 1:
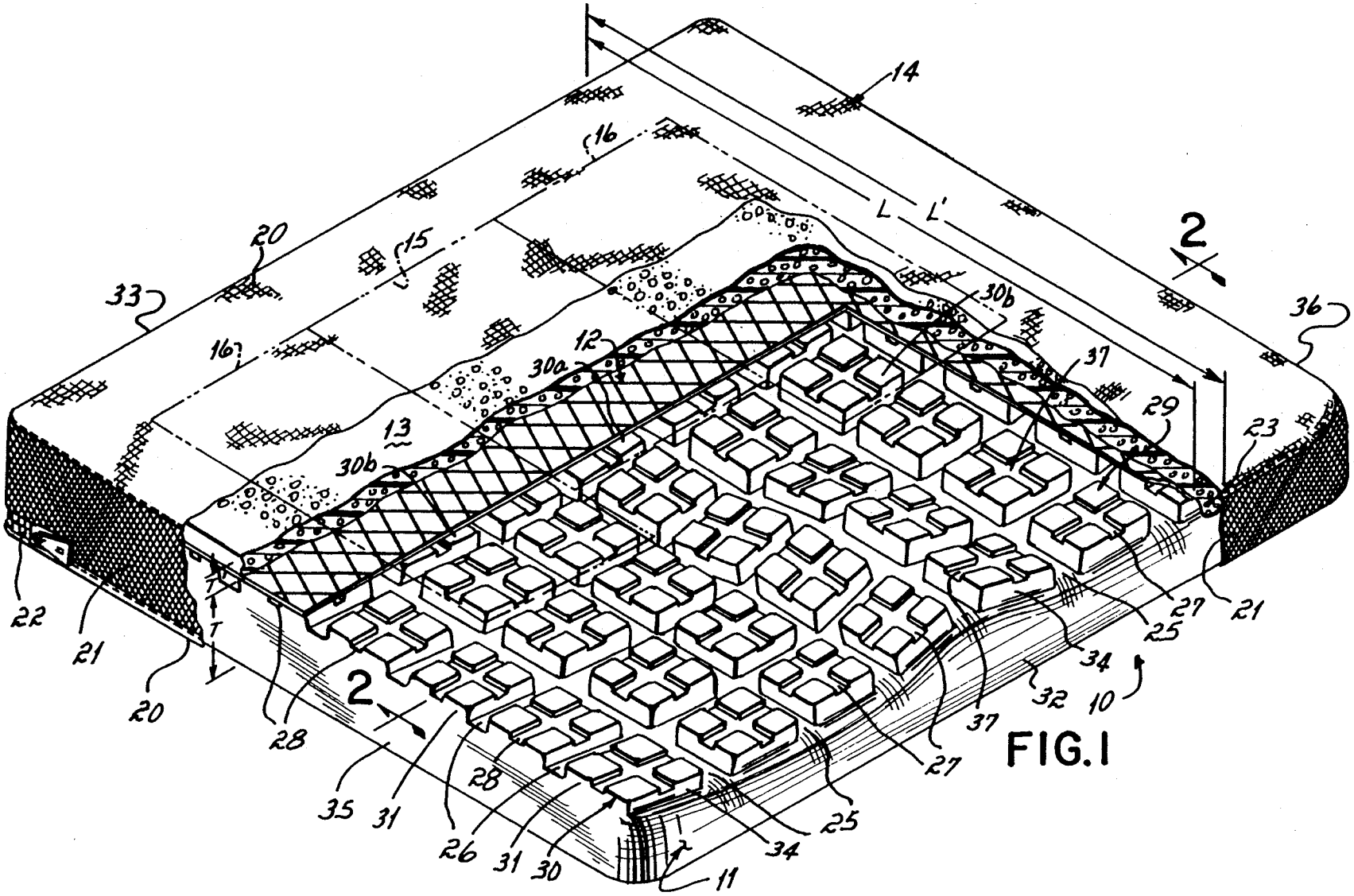
FIG. 1 is a partially broken away perspective view illustrating a cushion in accord with the principles of this invention.

A cushion 10 in accord with the principles of this invention is illustrated in FIG. 1. The cushion 10 is basically comprised of a specially configured base 11, a flexible mesh substrate 12 on top of that base, and a breathable foam layer 13 on top the mesh substrate, all enclosed within a breathable fabric cover 14. One basic advantage of this cushion 10 is that it permits air circulation through the cushion underneath the user's buttocks, thereby minimizing perspiration. Also, it is structured so that the cushion areas 15, 16 which underlie the user's coccyx and ischial bones, respectively, are of greater softness than the other areas of the cushion. All this cooperates to minimize discomfort and skin sores, i.e., decubitus ulcers, to the user.

The fabric cover 14 is comprised of a breathable fabric 20 on its top and bottom surfaces, and a mesh fabric 21 which defines its side wall surfaces. The cover's mesh fabric side walls 21 are provided to enhance airflow laterally through the cover 14 as promoted by the novel configuration of the base 11. The cover 14 includes a zipper 22 along one edge which allows the cover to be removed from the other cushion components for washing, and for cleaning those other components, if desired.

The foam layer 13 is a breathable foam of open cell construction. The foam layer 13 is of a thickness T' preferably no greater than about 25% the thickness T of the base 11. The foam layer 13 functions to promote air movement and comfort to the cushion's user. The foam layer 13 gives added support and cushioning to the entire cushion, but most importantly it allows air to circulate to the user's skin tissue. Note the foam layer 13 is of a length L' slightly longer than the front to back length L of the cushion's base 11, thereby providing a soft contoured edge 23 for the cushion 10 at the front edge thereof.

The flexible mesh substrate 12 functions as a carrier for the foam layer 13 positioned above it, and ensures that the desirable airflow through the cushion's base 11 does not get blocked because of the highly flexible foam layer 13 being deflected into primary 25, 26 and secondary 27, 28 airflow channels on the base's top surface 29. In other words, the mesh substrate prevents the highly flexible breathable foam layer 13 from conforming to the configuration of the base's top surface 29 when a user is sitting on the cushion.

The cushion's base 11 is comprised of a series of pods 30 connected in matrix configuration, the configuration illustrated in the figures being comprised of eight pods by seven pods with the eight pod rows 31 being aligned parallel to the front 32 and back 33 edges of the cushion's base and the seven pod columns 34 being aligned parallel with the side edges 35, 36 of the cushion's base. Each of these pods 30 is deformable in response to a user seated on the cushion. The pods 30 cooperate to define primary airflow channels 25 26 interiorly of and through the cushion 10, same comprising primary longitudinal airflow channels 25 from front edge 32 to back edge 33 of the cushion 10 and primary lateral airflow channels 26 from side edge 35 to side edge 36 of the cushion.

A cruciform configured recess 37 is defined on each pod's top surface 29. These cruciform recesses 37 cooperate to define secondary airflow channels 27, 28 internally of and through the cushion 10. These secondary airflow channels 27, 28 include longitudinal airflow channels 27 extending from front edge 32 to back edge 33 of the cushion, and lateral airflow channels 26 extending from side edge 35 to side edge 36 of the cushion.

The primary 25, 26 and secondary 27, 28 airflow channels through the cushion's base 10, which are maintained open by the flexible mesh substrate 12, and which allows airflow to be made accessible to a user's buttocks through the breathable foam layer 13 and breathable fabric cover 14, tends to eliminate perspiration on the user's buttocks while providing ventilation thereto as the user is seated on the cushion, thereby tending to minimize skin breakdown and resultant decubitus ulcers.

Figure 2:
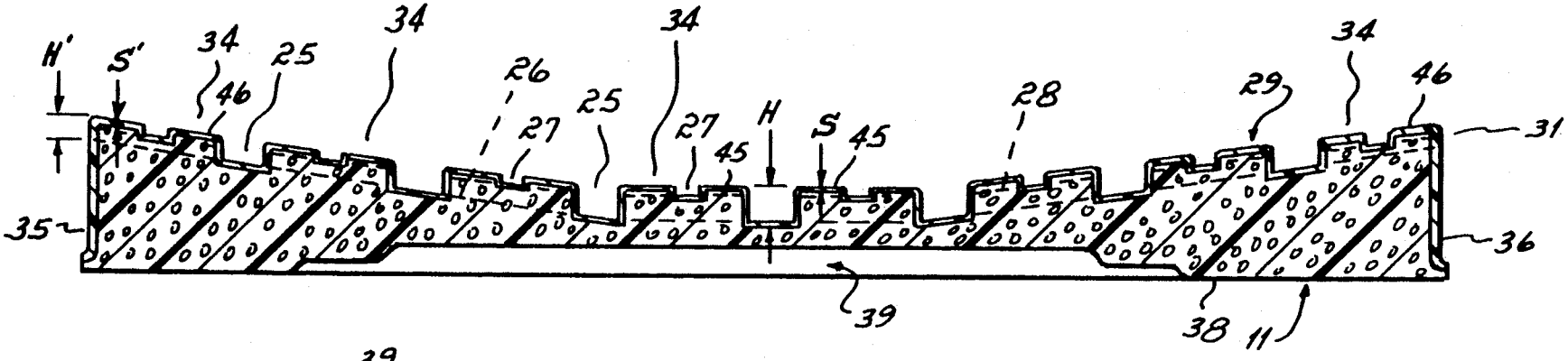
FIG. 2 is a cross-sectional view of one row of pods taken generally along lines 2—2 of FIG. 1.

The structure of the pods 30 on the base 11 is not the same throughout the entire top surface 30 area of the base. Specifically, the structure of the pods **30*a* in that base area 15 which underlies the user's coccyx bone, and in those base areas 16 which underlie the user's ischial bones, is different from that pod 30*b* structure throughout the rest of the cushion support surface. Note particularly, as illustrated in FIG. 2, that the height H of the pods 30*a* in the coccyx 15 and ischial 16 areas of the cushion 10 is greater than the height H' of the pods in the other areas of the cushion. Also, note the skin 45 thickness S of the taller pods 30*a* is less than the skin 46 thickness S' of the shorter pods 30*b*. In the thin wall higher pods 30*a*, therefor, less load vertical support is provided than with the thick wall shorter pods 30*b*. In other words, the aforementioned differences in pod 30 structure between the taller thinner wall pods 30*a* and the shorter thicker wall pods 30*b*** provides a cushion of varying load bearing support characteristics which minimizes the pressure points on a user's ischial and coccyx bones, and which spreads the seating support for that user to the user's surrounding tissue, when the user is seated on the cushion.

Figure 3:
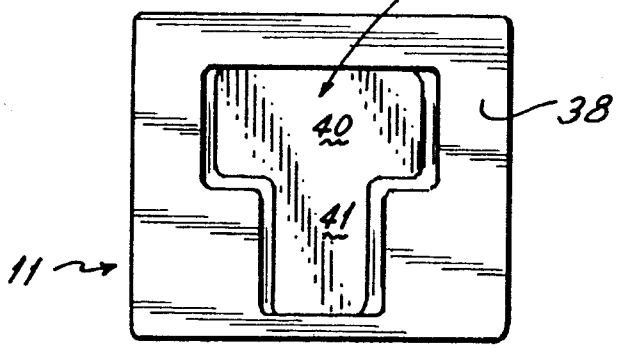
FIG. 3 is a bottom plan view of the cushion base.

In addition, the undersurface 38 of the base 11 is provided with a generally T-shaped cavity 39, see FIG. 3. The cross bar 40 of the T-shaped cavity 39 is oriented generally parallel to the cushion's rear edge 33, and underlies the coccyx area 15 and ischial area 16 of the cushion. The main leg 41 of the T-shaped cavity 39 is positioned so that it is located between a user's legs when the user is seated on the cushion, and is oriented generally parallel to the cushion's side edges 35, 36. The T-shaped cavity 39 increases deflection of the cushion 10 in the T-shaped cavity area so that those cushion areas around the T-shaped cavity bear the greatest body weight of the person seated thereon. Again, the function of the T-shaped cavity is to try to minimize the load pressure exerted against a user's ischial and coccyx bones so that the user's weight is primarily carried by the front 32, side 35, 36 and rear 33 edge areas of the cushion in addition to those areas underlying the user's thighs.

The base 11 is preferably fabricated from a molded foam which may be a self skinning foam such as polyurethane. On the other hand, a separate skin 45, 46 may be formed out of, for example, polyethylene, and then combined with a molded foam base formed out of, for example, polyurethane. This seating system provides improved pressure distribution without sacrificing seating stability because of the resilient foam properties of the base 11.

Having described in detail the preferred embodiment of our invention, what we desire to claim and protect by Letters Patent is:

I claim:

1. A cushion comprising a series of pods connected in a matrix configuration, said pods being deformable in response to a person seated on said cushion, said pods cooperating to define primary airflow channels through aid cushion edges from side edge to side edge and from front edge to back edge of said cushion, and a series of recesses defined in said pods, top surfaces, said recesses cooperating to define secondary airflow channels through said pod edges from side edge to side edge and from front edge to back edge of each pod, and said recesses each being of a generally cruciform configuration.

2. A cushion as claimed in claim 1, said cruciform recesses cooperating to define a series of generally longitudinal airflow channels through said cushion from front edge to back edge thereof and a series of generally lateral airflow channels through said cushion from side edge to side edge thereof.

3. A cushion as claimed in claim 1, said cushion comprising a base with which said pods are formed in a one-piece configuration, said base defining a cavity on its underside which underlies a user's ischial and coccyx bones when that user is seated thereon.

4. A cushion as claimed in claim 3, said cavity being of a generally T-shaped configuration, the crossbar of said T-shaped cavity being oriented generally parallel to said cushion's rear edge and the main leg of said T-shaped cavity being oriented between a user's legs when that user is seated thereon, said T-shaped cavity increasing deflection of said cushion in the T-shaped cavity areas thereof so that those cushion areas around said T-shaped cavity bear the greatest body weight of the user seated thereon.

5. A cushion as claimed in claim 1, said pods having their top surfaces contoured to fit the human form.

6. A cushion as claimed in claim 1, said cushion comprising a cover fabricated from a breathable fabric, said cover enclosing said pods yet permitting airflow through said primary and secondary airflow channels.

7. A cushion as claimed in claim 6, said cover comprising side walls of an open mesh weave fabric, said open mesh weave fabric not hindering airflow through said primary and secondary airflow channels.

8. A cushion as claimed in claim 1, said cushion comprising a breathable foam layer positioned on top of said pods, and a flexible open mesh substrate interposed between said foam layer and said pods, said mesh substrate preventing said foam layer from being substantially deformed into said primary airflow channels so as to insure airflow through said primary airflow channels when a user is seated on said cushion.

9. A cushion comprising a series of pods connected in a matrix configuration, said pods being deformable in response to a user seated on said cushion, said pods cooperating to define primary airflow channels through said cushion from side edge to side edge and from front edge to back edge thereof, a breathable foam layer positioned on top of said pods, a flexible open mesh substrate interposed between said foam layer and said pods, said mesh substrate substantially preventing said foam layer from being deformed into said primary airflow channels so as to insure airflow through said primary airflow channels when a user is seated on said cushion, and a base with which said pods are formed in a one piece configuration, said base defining an empty cavity on its underside which underlies a user's ischial and coccyx bones when that user is seated thereon, said empty cavity being of a generally T-shaped configuration, the crossbar of said T-shaped empty cavity being oriented generally parallel to said cushion's rear edge and the main leg of said T-shaped empty cavity being oriented between a user's legs when that user is seated thereon, said T-shaped empty cavity increasing deflection of said cushion in the T-shaped empty cavity areas thereof so that those cushion areas around said T-shaped empty cavity bear the greatest body weight of the user seated thereon.

10. A cushion as claimed in claim 9, said cushion comprising a series of recesses defined in said pods top surfaces, said recesses cooperating to define secondary airflow channels through said cushion at least one of from side edge to side edge and from front edge to back edge thereof.

11. A cushion as claimed in claim 10, said recesses each being of a generally cruciform configuration, said cruciform recesses cooperating to define secondary airflow channels through said cushion from side edge to side edge and from front edge to back edge thereof.

12. A cushion as claimed in claim 9, said cushion comprising a cover fabricated from a breathable fabric, said cover enclosing said pods yet permitting airflow through said primary and secondary airflow channels, said cover comprising side walls of an open mesh weave fabric, said open mesh weave fabric not hindering airflow through said primary and secondary airflow channels.

13. A cushion comprising a series of first pods located in those cushion areas which underlie and support a user's ischial and coccyx bones when that user is seated thereon, each of said first pods having a relatively thin wall covering a foamed interior, and being of a relatively greater height, to provide a relatively soft pod, and a series of second pods located in those cushion areas which do not underlie and support the user's ischial and coccyx bones, each of said second pods having a relatively thick wall covering a foamed interior, and being of a relatively lesser height, to form a relatively firm pod, the aforementioned differences in pod structure between said first and second pods providing a cushion of varying load bearing support characteristics which minimizes pressure points on the user's ischial and coccyx bones and spreads seating support to the user's surrounding tissue when the user is seated thereon.

14. A cushion as claimed in claim 13, said cushion comprising a series of recesses defined in said pods, top surfaces, said recesses cooperating to define secondary airflow channels through said cushion at least one of from side edge to side edge and from front edge to back edge thereof.

15. A cushion as claimed in claim 14, said recesses each being of a generally cruciform configuration, said cruciform recesses cooperating to define secondary airflow channels through said cushion from side edge to side edge and from front edge to back edge thereof.

16. A cushion as claimed in claim 14, said cushion comprising a base with which said pods are formed in a one piece configuration, said base defining a cavity on its underside which underlies a user's ischial and coccyx bones when that user is seated thereon.

17. A cushion as claimed in claim 16, said cavity being of a generally T-shaped configuration, the crossbar of said T-shaped cavity being oriented generally parallel to said cushion's rear edge and the main leg of said T-shaped cavity being oriented between a user's legs when that user is seated thereon, said T-shaped cavity allowing increased deflection of said cushion in the T-shaped cavity area thereof so that those cushion areas around said T-shaped cavity bear the greatest body weight of the user seated thereon.

18. A cushion as claimed in claim 13, said cushion comprising a breathable foam layer positioned on top of said pods, and a flexible open mesh substrate interposed between said foam layer and said pods, said mesh substrate preventing said foam layer from being substantially deformed into said primary airflow channels so as to insure airflow through said primary airflow channels when a user is seated on said cushion.

19. A cushion as claimed in claim 18, said cushion comprising a cover fabricated from a breathable fabric, said cover enclosing said pods yet permitting airflow through said primary and secondary airflow channels, said cover comprising side walls of an open mesh weave fabric, said open mesh weave fabric not hindering airflow through said primary and secondary airflow channels.

* * * * *

UNITED STATES PATENT AND TRADEMARK OFFICE

CERTIFICATE OF CORRECTION

PATENT NO. : 4,989,284

DATED : February 5, 1991

INVENTOR(S) : Paul B. Gamm, et al

It is certified that error appears in the above-identified patent and that said Letters Patent is hereby corrected as shown below:

On the title page, Item [19] "Gamm" should read --Gamm et al --.

Item [75] Inventors: Please add --Paul K. Meunchen, Cincinnati, Ohio -- as a named inventor, in addition to Paul B. Gamm, already named.

Signed and Sealed this

Twentieth Day of April, 1993

*Attest:*

MICHAEL K. KIRK

*Attesting Officer*

*Acting Commissioner of Patents and Trademarks*